US008500369B2

(12) United States Patent
Mohr

(10) Patent No.: US 8,500,369 B2
(45) Date of Patent: Aug. 6, 2013

(54) METHOD AND DEVICE FOR ENVIRONMENTALLY FRIENDLY RAMMING UNDER WATER

(75) Inventor: Rainer Mohr, Klein Rönnau (DE)

(73) Assignee: Menck GmbH, Kaltenkirchen (DE)

( * ) Notice: Subject to any disclaimer, the term of this patent is extended or adjusted under 35 U.S.C. 154(b) by 391 days.

(21) Appl. No.: 12/280,072

(22) PCT Filed: Feb. 20, 2007

(86) PCT No.: PCT/EP2007/001452

§ 371 (c)(1),
(2), (4) Date: Jan. 27, 2009

(87) PCT Pub. No.: WO2007/096132

PCT Pub. Date: Aug. 30, 2007

(65) Prior Publication Data

US 2009/0129871 A1 May 21, 2009

(30) Foreign Application Priority Data

Feb. 20, 2006 (DE) ..... 10 2006 008 095

(51) Int. Cl.
*E02D 7/02* (2006.01)
*E02D 13/00* (2006.01)

(52) U.S. Cl.
USPC ..... 405/232; 181/198

(58) Field of Classification Search
USPC ..... 405/232, 249; 367/1; 181/175, 198
See application file for complete search history.

(56) References Cited

U.S. PATENT DOCUMENTS

| | | | | |
|---|---|---|---|---|
| 2,122,517 | A * | 7/1938 | Curtis | 175/135 |
| 3,177,466 | A * | 4/1965 | Arnoldi | 367/1 |
| 3,817,335 | A | 6/1974 | Chelminski | |
| 3,975,918 | A | 8/1976 | Jansz | |
| 4,479,550 | A | 10/1984 | Kühn et al. | |
| 5,394,786 | A * | 3/1995 | Gettle et al. | 86/50 |
| 5,752,571 | A * | 5/1998 | Sapozhnikov | 173/206 |
| 6,567,341 | B2 * | 5/2003 | Dreyer et al. | 367/1 |
| 2005/0083783 | A1 * | 4/2005 | Baskerville et al. | 367/1 |

FOREIGN PATENT DOCUMENTS

| | | |
|---|---|---|
| CH | 67379 | 2/1914 |
| DE | 1905981 | 10/1970 |
| DE | 1634289 | 12/1970 |
| DE | 1784396 | 7/1971 |
| DE | 2237133 | 2/1974 |
| DE | 2358655 | 5/1974 |
| DE | 2538642 | 3/1977 |
| DE | 2915542 | 8/1980 |

(Continued)

OTHER PUBLICATIONS

Würsig et al., Development of an Air Bubble Curtain to Reduce Underwater Noise of Percussive Piling, Marine Environmental Research 49 (2000) 79-93.*

(Continued)

*Primary Examiner* — Tara M. Pinnock
(74) *Attorney, Agent, or Firm* — Greenblum & Bernstein P.L.C.

(57) ABSTRACT

The present invention relates to a method and a device for environmentally friendly ramming under water. To reduce the noise input under water, the machine and the material that is to be rammed are surrounded by a fixed flooded sleeve. The sleeve advantageously has a sandwich-like structure.

17 Claims, 3 Drawing Sheets

FOREIGN PATENT DOCUMENTS

| | | |
|---|---|---|
| DE | 3047375 | 6/1982 |
| DE | 2514923 | 2/1985 |
| DE | 3634905 | 4/1988 |
| DE | 10302219 | 9/2004 |
| EP | 0059798 | 9/1982 |
| GB | 1397137 | 6/1975 |
| GB | 2046818 | 11/1980 |
| JP | 60-159218 | 8/1985 |

OTHER PUBLICATIONS

English language Abstract of JP 60-159218, Aug. 20, 1985.
English language Abstract of DE 10302219, Sep. 9, 2004.
English language Abstract of EP 0059798, Sep. 15, 1982.
Applicant's Brief Statement of Relevancy for DE 3047375, DE 2538642, DE 2358655, CH 67379, DE 2514923, DE 2915542, DE 1905981, DE 10302219, DE 2237133, DE 1784396, and DE 1634289.
Notice of Opposition to a European Patent, Jan. 21, 2011.
"Hydroacoustic Measurements During Pile Driving at the Hood Canal Bridge, Sep. through Nov. 2004," written by T.J. Carlson et al, Batelle Marine Sciences Laboratory, Sequim WA, USA. Published by Washington State Department of Transportation, Nov. 2005.
Scan of the front page of DEWI Magazin Nr. 27, Aug. 2005, concerning the date of publication of "3" and carrying the table of contents of the volume.

* cited by examiner

METHOD AND DEVICE FOR ENVIRONMENTALLY FRIENDLY RAMMING UNDER WATER

TECHNICAL FIELD

Method and device for environmentally friendly ramming under water

The invention relates to a method and a device for the environmentally friendly driving of material to be rammed under water.

Offshore ramming work is carried out under water to establish foundations, for example, for drilling platforms and wind turbines. For wind turbines, large monopiles with a diameter of more than four meters are rammed into the seabed. This ramming results in an underwater noise input not to be overlooked, which can have a negative impact on the marine fauna, for example, the sense of direction of sea mammals can be impaired.

The object of the present invention is therefore to reduce the noise input into the environment with ramming work, in particular under water.

To reduce the noise input, a water-free working chamber is known from DE 2915542 C2, in the interior of which working chamber the pile is arranged. However, this measure presupposes that the working chamber is designed for the high underwater pressures at greater water depths and is correspondingly heavy.

A device for reducing the noise emission of a driven pile is known from DE 2514923 C2, during the driving of which into the ground, the pile is covered over its entire length by a folding jacket of flexible material.

The disadvantage of a device of this type is that it is not suitable for the rough conditions at sea, because the casing can be easily damaged during handling.

DISCLOSURE OF THE INVENTION

The object of the invention is to disclose a method and a device that is sufficiently robust for carrying out offshore ramming work and thereby substantially reduces the noise input into the water.

The method object is attained in that the ram and the pile are surrounded by a sound-insulating tubular flooded sleeve.

The device object is attained in particular by a machine, in particular a ram, for driving piles or the like, the device being covered by at least one sound-insulating fixed sleeve that is flooded.

The flooding is preferably carried out by the surrounding water, whereby differences in pressure are equalized so that the sleeve advantageously is subject to little static load.

In the embodiment of the device it is provided for the sleeve to be tubular, which advantageously reduces the expenditure for producing the sleeve.

Since the wall of the sleeve comprises a sound-insulating material, the noise emission is reduced by absorption directly at the point of origin.

The damping can be further improved if the sound-insulating material of the wall is embodied in an open-pore and/or closed-pore manner. With the closed pores, the pore content can be selected such that it improves the sound-insulating properties of the material.

Particularly good damping effects result if the wall has a thickness that is less than a quarter of the sound wavelength, preferably in the order of magnitude of a quarter.

The properties of the sleeve can be adapted to the specific conditions of use by a sandwich-like structure of the sleeve wall, if the wall of the sleeve has an outer shell and preferably is connected thereto. The outer shell thus protects the sleeve and additionally can fulfill static functions in that it gives the sleeve the necessary rigidity.

If furthermore the wall of the sleeve has an inner shell, preferably is also connected thereto, the inner shell can provide an additional protection from damage and additionally increase the mechanical rigidity.

A different oscillatory behavior of the two shells results because the materials and/or the thickness of the inner shell and outer shell are embodied differently, so that the material of the sleeve to which the shells are connected can even better damp the oscillations occurring.

The damping properties of the material can be better adjusted with the measure that the pores are filled with gas and/or with a liquid that is different from water.

The handling of the entire sleeve is advantageously simplified in that the sleeve comprises individual length sections that are preferably connected to one another in a telescoping manner and/or the sleeve is assembled from at least two segments divided in the axial direction. The segments can also be embodied as half-shells so that the sleeve can be opened in a hinged manner for assembly reasons. In the hinged open state the sound-insulating tube or the sleeve can be placed around the material that is to be rammed and subsequently closed again. The objective thereby is to minimize the crane height in the case of a sequential placement of the material to be rammed and of the sound insulation in great water depths. If the material to be rammed is placed first and if there is neither a telescoping unit nor a segmentation in the axial direction, the entire sound-insulating tube would have to be lifted over the material to be rammed or vice versa.

The sound emission can be further reduced if an upper end of the sleeve is embodied closed by a cover.

It is advantageously provided for piles that may not have sufficient inherent stability, that the sleeve has at least one damping guide element for guiding a pile.

These guide elements can dampen additionally in a particularly advantageous manner if at least one guide element is arranged outside self-vibrating nodes of the pile.

Since the machine and sleeve are embodied as a unit to be handled jointly, no additional hoisting machines are necessary at the building site. The ramming work can be carried out with the existing building site equipment.

The invention is described by way of example in a preferred embodiment with reference to a drawing, wherein further advantageous details can be taken from the figures of the drawing.

Functionally identical parts are thereby provided with the same reference numbers.

DETAILED DESCRIPTION

Figure 1:
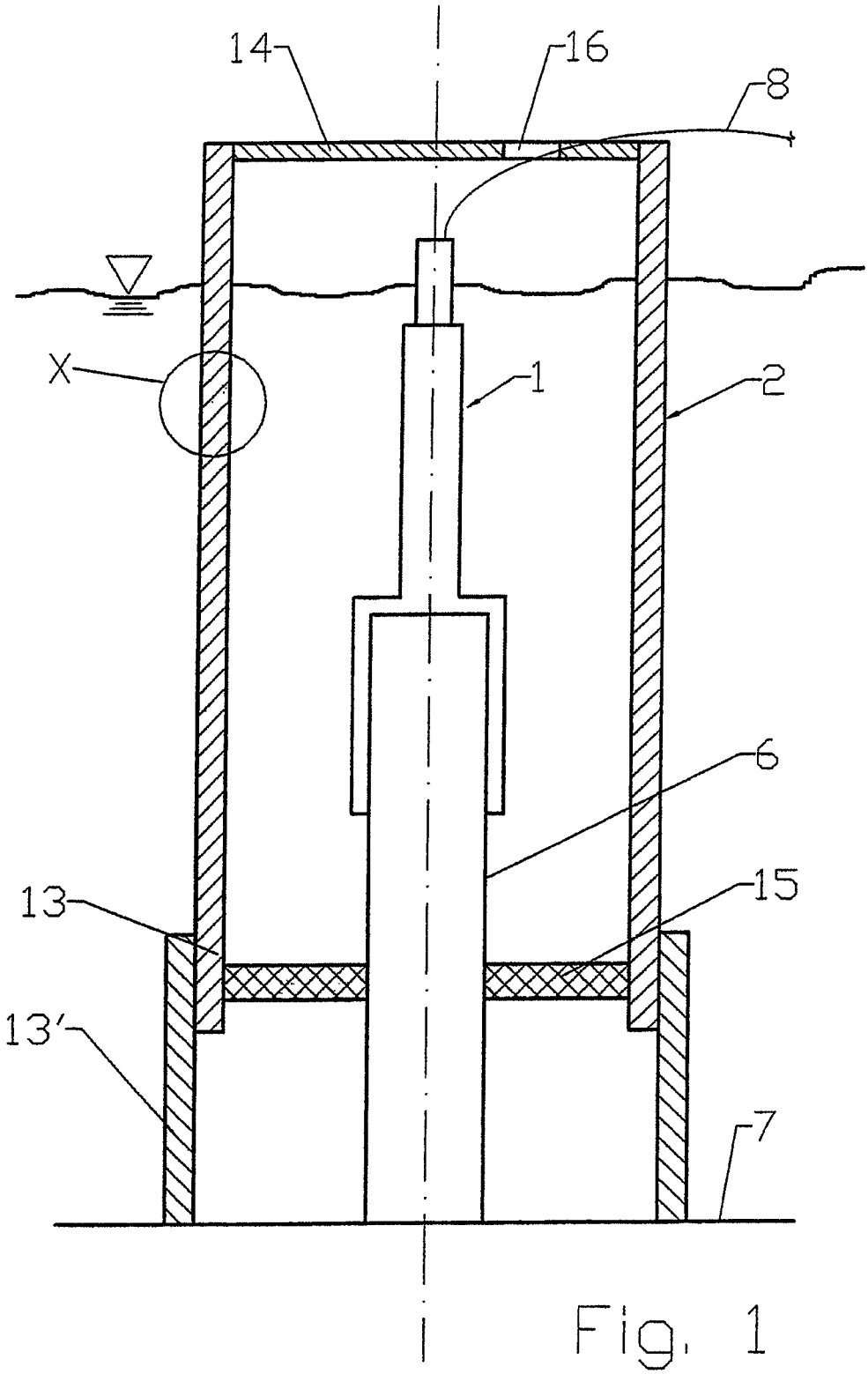
FIG. 1: A diagrammatic axial section through the device according to the invention.

In FIG. 1 the sound-insulating sleeve 2 according to the invention encloses the pile 6, on which the machine, i.e., the ram 1, is located at the upper end. The inner diameter of the sound-insulating sleeve 2 embodied as a tube must therefore be greater than the largest outer diameter of the machine. The sound-insulating sleeve 2 is placed on the ground 7 or suspended in a suitable suspension with the machine 1 as one unit. The material to be rammed is supported in the sleeve 2 by means of guides 15 in a suitable manner if the construction of the material to be rammed or sleeve is not inherently stable due to its length. The tube or the sleeve can be open at the top and at the bottom or closed by means of a cover 14. In a closed version, the supply lines 8 to the machine 1 and the material to be rammed 6 to be installed require a suitable feed-through. The sound-insulating sleeve 2 can be used above water as well as under water. It can comprise one piece or several sections 13, 13' that are assembled in a suitable manner. A telescoping embodiment is particularly space-saving.

Figure 2:
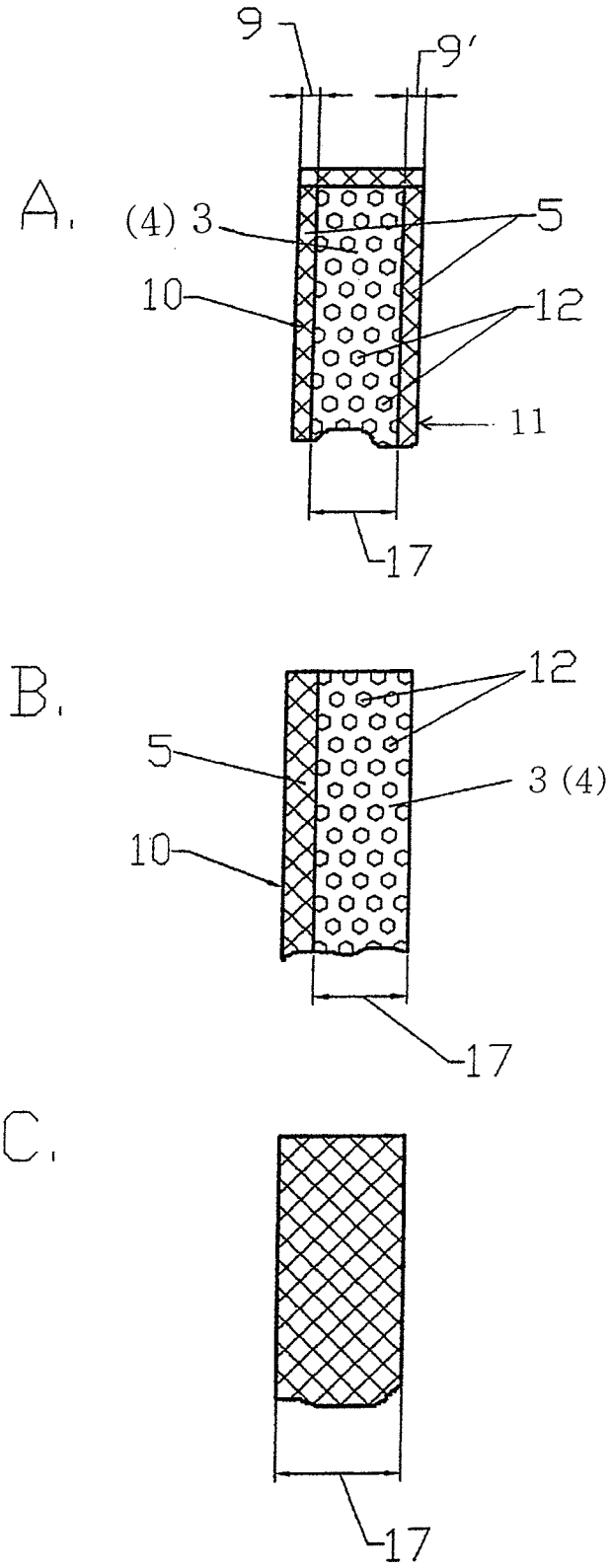
FIG. 2: The detail x from FIG. 1 in three alternative embodiments.

FIG. 2 shows three alternatives a, b and c of the wall 3 of the sound-insulating sleeve 2. In variant a the tube is of a composite material, i.e., a combination of a carrier material 5, which determines the rigidity of the tube 2, as an outer shell 10, and a sound-absorption material 4 that fills the clearance between the inner shell 11 and outer shell 10 of the tube 2. For underwater applications the enclosing material must withstand the ambient pressure so that the sound-absorption material 4 is not compressed under the pressure and thus loses its sound-insulating effect. The carrier material 5 itself can likewise have a sound-insulating effect and can also be used without additional sound-absorption material 4 as a sound-insulating sleeve pursuant to variant c. If the sound-absorption material is pressure-stable, it is sufficient to connect the sound-absorption material to the carrier material, pursuant to variant b. The sound-absorbing properties can be adjusted in wide ranges through the type and size of the pores 12 and the filling thereof. It is particularly effective if the thickness 9 of the outer shell and the thickness 9' of the inner shell are different, because this results in a different oscillatory behavior. A particularly dimensioned wall thickness 17 of the insulating material and/or of the shells also has an advantageous effect.

The sleeve can also be embodied from more than three layers in an analogous manner, without leaving the extent of protection of the invention.

Figure 3:
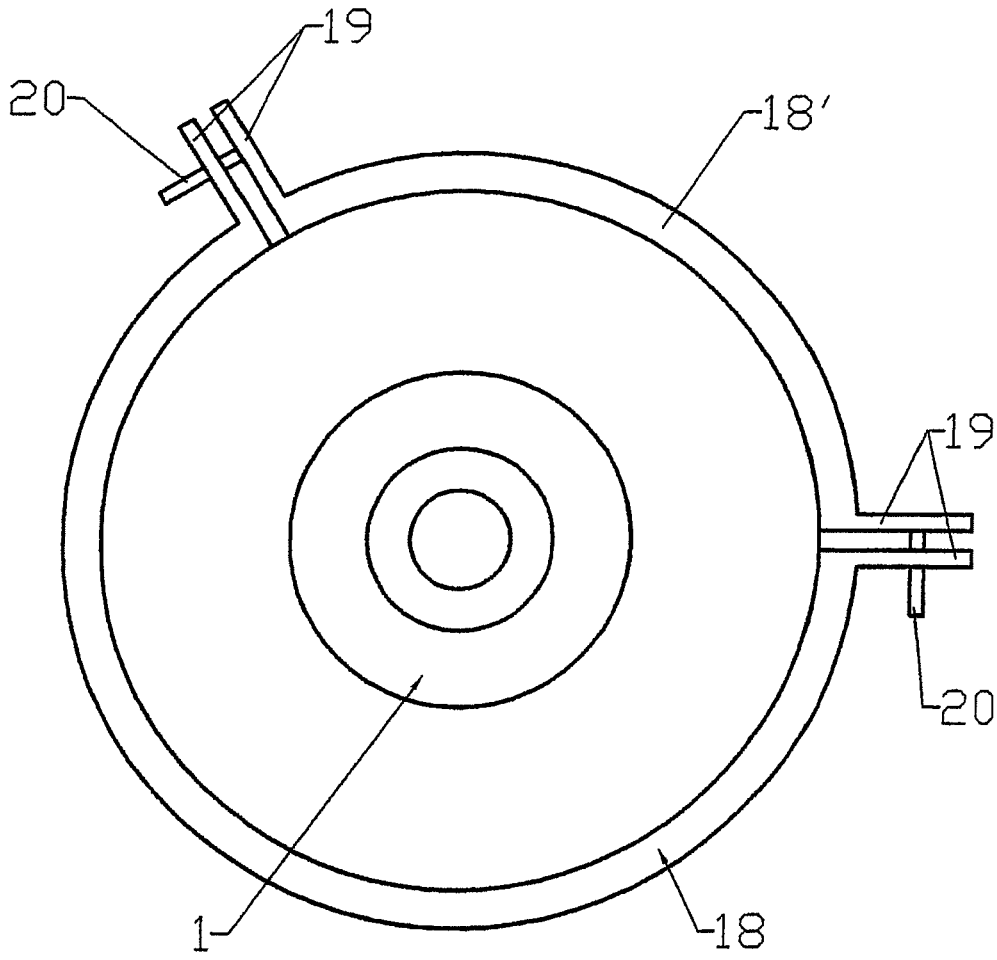
FIG. 3: A view of the arrangement according to FIG. 1, but with a segmentation in the axial direction instead of in a telescoping embodiment.

FIG. 3 shows a view of the arrangement according to FIG. 1, but with a segmentation made in the axial direction instead of in a telescoping embodiment. In the case drawn the segment shells 18, 18' are asymmetrically divided and provided with flanges 19. The segment shells can be detachably connected by hooks 20 mounted on the flanges, which hooks engage in corresponding openings of the mating flange. Alternatively, two segment shells can also be connected by hinges (not shown), so that one of the shells can be easily opened and closed again like a door for assembly purposes.

LIST OF REFERENCE NUMBERS

1 Machine, ram
2 Sound-insulating sleeve
3 Wall
4 Sound-absorption material
5 Carrier material
6 Material to be rammed
7 Ground
8 Supply lines
9, 9' Thickness of the shell
10 Outer shell
11 Inner shell
12 Pores
13, 13' Section
14 Cover
15 Guide element
16 Opening
17 Wall thickness
18, 18' Segment
18 Flange
19 Hook

The invention claimed is:

1. A method for driving material, the method comprising:
ramming the material under water;
surrounding at least the material to be rammed with a sound-insulating fixed sleeve that is water flooded, the sleeve comprising: a sound absorption material, an outer shell and an inner shell; and
providing the sleeve such that an inner surface of the sleeve surrounds an outer surface of the material to be rammed, and
the sound absorption material being sandwiched between the outer shell and the inner shell.

2. A ramming assembly for driving material under water, the ramming assembly comprising:
a ram configured to ram the material under water;
a sound-insulating fixed sleeve that is water flooded, the sleeve comprising: a sound absorption material, an outer shell and an inner shell; and
an inner surface of the sleeve surrounding an outer surface of the ram and the material to be rammed, and wherein the sound absorption material of the sleeve is sandwiched between the outer shell and the inner shell.

3. The ramming assembly according to claim 2, wherein the sleeve is a tubular sleeve having a circular cross section.

4. The ramming assembly according to claim 3, wherein a wall of the sleeve is made of the sound-absorption material.

5. The ramming assembly according to claim 2, wherein a wall of the sleeve comprises at least one of open pores and closed pores.

6. The ramming assembly according to claim 5, further comprising the pores being filled with at least one of a gas and liquid that is different from water.

7. The ramming assembly according to claim 2, wherein a wall of the sleeve has a thickness that is less than a quarter of a sound wavelength.

8. The ramming assembly according to claim 2, wherein an outer wall of the sleeve has the outer shell connected thereto.

9. The ramming assembly according to claim 8, wherein an inner wall of the sleeve has the inner shell connected thereto.

10. The ramming assembly according to claim 9, further comprising the inner shell and outer shell being made of different materials.

11. The ramming assembly according to claim 2, wherein the sleeve comprises individual length sections that are connected to one another in a telescoping manner and/or the sleeve is assembled from at least two segments divided in the axial direction.

12. The ramming assembly according to claim 2, wherein an upper end of the sleeve is closed with a cover.

13. The ramming assembly according to claim 2, wherein the sleeve has at least one damping guide element for guiding a pile.

14. The ramming assembly according to claim 2, wherein at least one guide element is arranged outside the material.

15. The ramming assembly according to claim 2, wherein the ram and the sleeve are formed as a unit for handling.

16. The ramming assembly according to claim 2, wherein at least one of the outer shell and the inner shell provides the sleeve with rigidity.

17. The method according to claim 1, wherein at least one of the outer shell and the inner shell provides the sleeve with rigidity.

* * * * *